United States Patent [19]

Hemingway

[11] 4,209,901

[45] Jul. 1, 1980

[54] SHEARGUARD

[76] Inventor: Joseph M. Hemingway, 14932 Avelon, Dolton, Ill. 60419

[21] Appl. No.: 29,662

[22] Filed: Apr. 13, 1979

[51] Int. Cl.[2] ..... B26B 13/00

[52] U.S. Cl. ..... 30/233

[58] Field of Search ..... 30/231, 233, 250, 254, 30/257

[56] References Cited

U.S. PATENT DOCUMENTS

| | | | |
|---|---|---|---|
| 2,801,468 | 8/1957 | Anderson | 30/254 |
| 3,046,655 | 7/1962 | Sproson | 30/233 |
| 3,143,799 | 8/1964 | Gover | 30/257 |

*Primary Examiner*—Jimmy C. Peters
*Attorney, Agent, or Firm*—Watson D. Harbaugh

[57] ABSTRACT

In the present invention, a pair of conventional sheet metal shears may be safeguarded quickly against hand injuries for conventional uses as well as equipped and prepared for special conditions, and, easily restored for other or regular uses with respect to either one or both shear blades of standard shears regularly employed for cutting and trimming sheet metal. An improved safety snap-on guard can be used for all work, either by re-orienting the guard or inverting the shears with the guard in place.

5 Claims, 5 Drawing Figures

FIG. 1
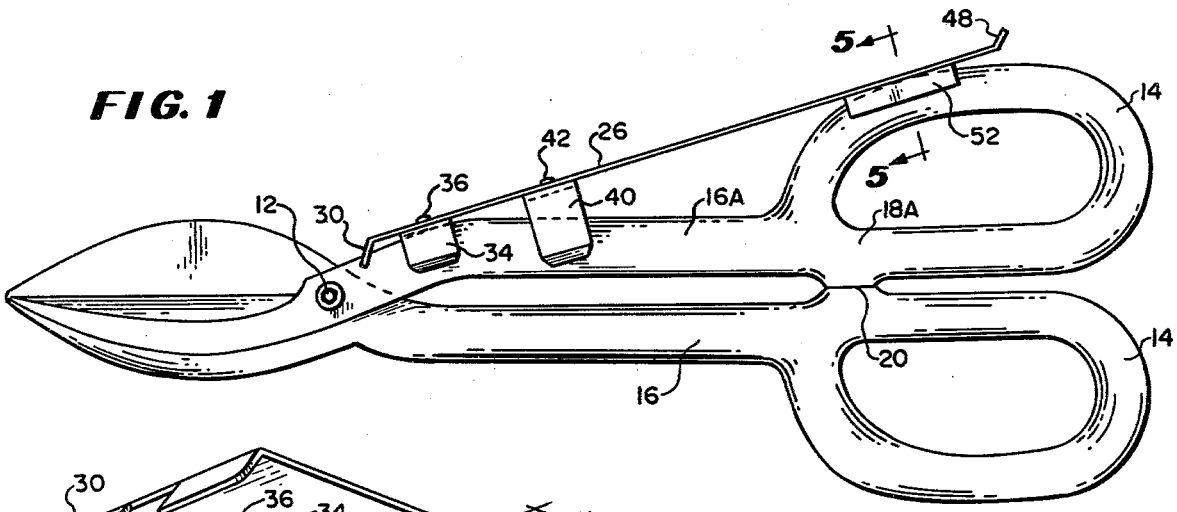
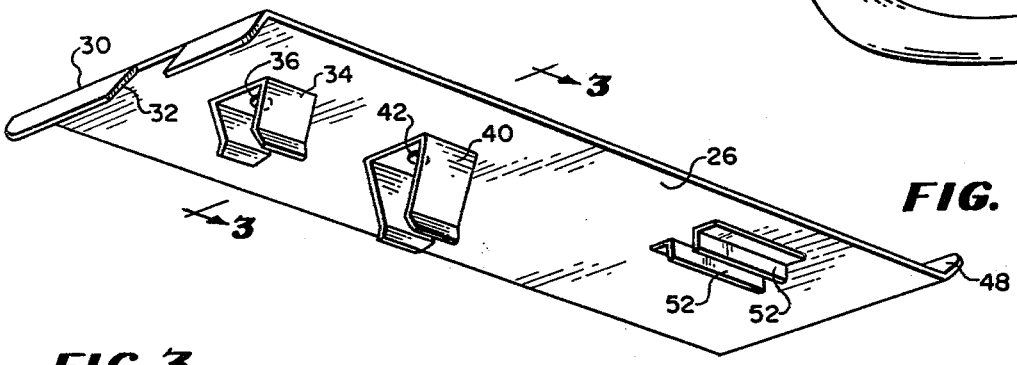
FIG. 2
FIG. 3
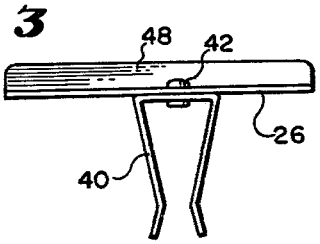
FIG. 4
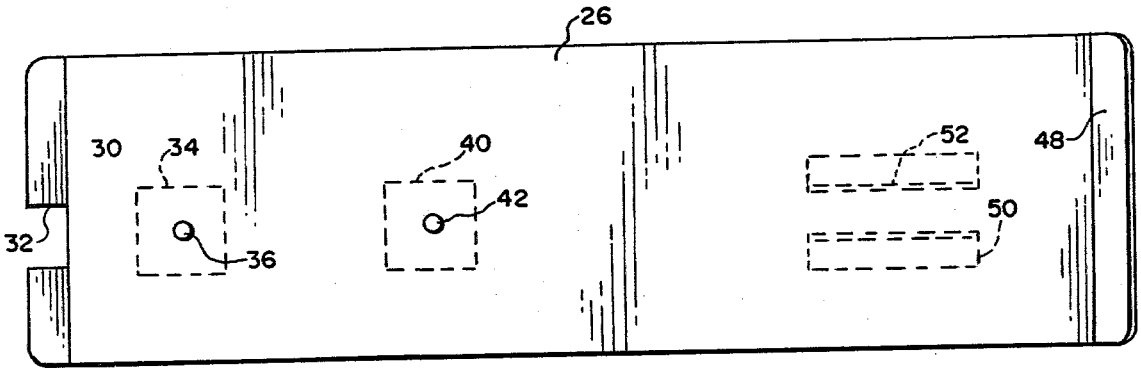
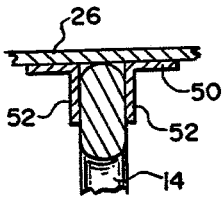
FIG. 5

SHEARGUARD

BACKGROUND OF THE INVENTION

When using a hand shear for cutting light gauge sheet metal, the workman is often in danger of injury, particularly to his hands, with respect to any narrow strip severed on either side of the shears which travels along the shear element in proximity or contact with the operator's hand.

Heretofore, guards have been provided for safety reasons for cutting sheet metal with hand shears but they have shortcomings which discourage their use where dangers to workmen are involved, or they interfer with making accurate straight or curved cuts, particularly irregular cuts or cuts near the right or left hand edges, and where ribbon cuts are made to improve curved edges because of curling and twisting pressures.

It has been found that little if any danger occurs in cutting a sheet in half since there is no curl which otherwise occurs as with a narrow strip where the narrow trim tends to curl with sharp edges engaging the workman's fingers, the metal curling upwardly or downwardly across a workman's shear operating hand depending upon the direction in which the cut is made or curved. Inverting conventional shears may help by them being able to receive the guard quickly and easily on either shear member or both. This dual use is preferred because the handles of many pairs of shears are different for manipulating the respective shear blades for different purposes, and there are right and left hand overlapping shears for some special applications. Moreover, it is highly desirable to safeguard conventional shears when needed rather than multiply the number of special shears which only perform limited or special functions.

OBJECTS OF THE INVENTION

One of the objects of the invention is to provide safety for workmen cutting, shaping and trimming sheet metal with hand shears by the use of a light weight guard member that is easily applied to the shears to protect the operator's hand and prevent direct contact with the sharp shear-cut edge of the metal.

Another object of the invention is to provide a light weight guard that is easily and readily snapped into place and removed from a stable protective position to encourage its use because of its ease of handling and attaching when desirable, and, its ease of detachment when not needed. Moreover, its easy positioning and operation are readily apparent to a workman at a glance.

The guard device can be constructed of a light gauge spring material, steel coated for engaging a shear handle and having two tempered steel snap clips that grip the handle and secure the device against displacement under working conditions.

IN THE DRAWINGS

FIG. 1 is a side elevational view of a conventional pair of sheet metal shears equipped to embody the invention and safeguard the hands of the user.

FIG. 2 is a perspective view of the protective device dissembled from a pair of manually operated conventional sheet metal shears.

FIG. 3 is a section taken upon line 3—3 of FIG. 2

FIG. 4 is a plan view of the protective attachment, and

FIG. 5 is a sectional view taken on line 5—5 of FIG. 1.

DESCRIPTION OF THE INVENTION

More particularly, a pair of conventional metal cutting shears 10 is illustrated in FIG. 1, pivotally mounted at 12 intermediate their ends and preferably comprising two identical members having handles 14 whereby movement of the handles towards and away from each other scissor the cutter ends to sever sheet metal progressively.

The handles 14 have conventional arms serving as levers 16 with the manually actuated elements comprising closed loops 18, either one of which can receive three or four fingers of a workman's hand while the other receives the thumb portion of a workman's hand. Mutually engaging stops at 20 limit the closing movement.

At their other ends the levers 16 have sharp mutually engaging shearing-edges which sever sheet metal when the handles 14 are forced to close. The levers 16 are cross-sectionally rectangular and mutually clear each other except at the stops 20 where the handle loops 18 occupy the same plane for ease in gripping and operation.

The shear guard 26 is a comparatively wide flexible plate disposed adjacent to the pivot pin 12 where it is bent downwardly at 30 and notched at 32 to straddle an upper portion of the uppermost handle at 32 to support the end thereof against side movement, while a U-shaped spring clip 34, riveted or welded at 36 on the guard 26 spring-clamps against opposite sides of the uppermost arm 16A for securement against lateral movement while a second, and longer U-shaped spring clip 40 welded to the plate 26 at 42 coacts with the same handle 16A not only to hold the plate 26 oriented and normal to the plane of the two handles but also in alignment with them.

The outer end of the plate is terminally bent upwardly at 46 to provide a rectilineal reinforcing flange 48 upon which in the orientation illustrated, the shears may rest vertically if and when the guard 26 engages and supports the shears on a horizontal work table top (not illustrated).

Preferably another elongated clamp means 50 about the length of the forward curved portion of the handle 18A may be spot welded to the guard with the edges extending downwardly to provide side flanges 52 that engage the outer side portions of the handle 14 for mutual support against relative lateral movement. This along with the notch 32 assists in maintaining protective alignment of the guard 26 with the handle 14, which receives the clips 34 and 40 and the upward facing cutting edge thereof raises the cut edge of a work piece to pass upwardly and along the guard 26 over and out of any contact with a hand operating the shears at 18.

What is claimed is:

1. The combination of a pair of pivotally mounted elongated sheet metal cutting shear members having coplanar loop handles at one end and a sheet metal hand guard comprising a flat member supported normal to said planar loop handles resting against the outer edge of one of the loop handles and including clamp members intermediate its ends engaging said one of said members in the plane of its pivotal movement against relative lateral movement.

2. The combination defined in claim 1 in which said flat member is notched at one end adjacent to the pivotal axis to straddle one of said shear members against lateral displacement.

3. The combination defined in claim 1 in which said flat member includes securement means engaging opposite sides of the loop handle against movement laterally with respect thereto.

4. The combination defined in claim 2 in which said flat member has a reinforcing end flange member in which said notch is provided.

5. The combination defined in claim 3 in which said flat member terminally has outwardly directed reinforcing end flange which supports the loop handles for vertical actuation when resting on a horizontally disposed flat surface.

* * * * *